US005492076A

United States Patent [19]

Kobayashi

[11] Patent Number: 5,492,076

[45] Date of Patent: Feb. 20, 1996

[54] PATROL BOAT

[75] Inventor: Noboru Kobayashi, Iwata, Japan

[73] Assignee: Yamaha Hatsudoki Kabushiki Kaisha, Iwata, Japan

[21] Appl. No.: 223,218

[22] Filed: Apr. 5, 1994

Related U.S. Application Data

[63] Continuation-in-part of Ser. No. 35,942, Mar. 23, 1993, Pat. No. 5,366,028.

[30] Foreign Application Priority Data

Apr. 5, 1993 [JP] Japan ..... 5-078314

[51] Int. Cl.[6] ..... B63B 17/00

[52] U.S. Cl. ..... 114/362; 440/88; 441/80

[58] Field of Search ..... 114/362, 61, 258, 114/259, 365, 368, 253, 254; 441/80, 82, 84, 83, 129; 440/88; 5/625, 627

[56] References Cited

U.S. PATENT DOCUMENTS

| | | | |
|---|---|---|---|
| 3,370,310 | 2/1968 | La Tour | 441/80 |
| 3,403,652 | 10/1968 | Hardy | 114/259 |
| 3,426,367 | 2/1969 | Bradford | 5/627 |
| 3,998,176 | 12/1976 | Stout et al. | 114/61 X |
| 4,343,056 | 8/1982 | McDonald | 441/84 |
| 4,543,898 | 10/1985 | Castilla | 114/39.1 |
| 4,742,795 | 5/1988 | DePrey et al. | 114/362 |
| 4,876,756 | 10/1989 | Vaccaro | 441/129 X |
| 5,366,028 | 11/1994 | Kobayashi | 114/362 |

FOREIGN PATENT DOCUMENTS

| | | | |
|---|---|---|---|
| 2241445 | 3/1975 | France . | |
| 2736873 | 3/1979 | Germany . | |
| 3429990 | 1/1985 | Germany | 441/80 |
| 1103935 | 2/1968 | United Kingdom | 114/61 |
| 1585865 | 3/1981 | United Kingdom . | |

OTHER PUBLICATIONS

European Search Report dated Apr. 1, 1994; Application Number EP 93 11 2192.5; completed Dec. 29, 1993.

*Primary Examiner*—Sherman Basinger

*Attorney, Agent, or Firm*—Knobbe, Martens, Olson & Bear

[57] ABSTRACT

A patrol or rescue boat that is formed with a catamaran hull so as to provide a generally open deck area that extends through the rear of the transom for facilitating the transfer of injured persons onto the deck area from the body of water. In addition, a removable front deck is also provided. The rear deck has a pivotal portion so as to facilitate transfer of injured persons onto the deck and then to form an enclosure so that heated water can be flooded into the deck from the cooling jacket of the engine so as to heat an injured person. A litter is provided that has a pair of side poles and an open netting received on the side poles. The side poles are provided with flotation devices so as to float the body of a victim in the water and so as to facilitate transfer of the victim and litter into the deck area of the patrol boat.

40 Claims, 11 Drawing Sheets

PATROL BOAT

CROSS-REFERENCE TO RELATED APPLICATION

This application is a continuation-in-part of my application of the same title, Ser. No. 08/035,942, filed Mar. 23, 1993, and assigned to the assignee hereof, now issued as U.S. Pat. No. 5,366,028 on Nov. 22, 1994.

BACKGROUND OF THE INVENTION

This invention related to a patrol boat and more particularly to an improved watercraft that is designed for facilitating at sea rescue and a litter therefor.

There is a need for a type of watercraft that is particularly useful in rescuing individuals at sea. Such a watercraft should be constructed in such a way as to permit high speed operation and yet be capable of easily moving an injured person from the body of water onto the watercraft for treatment and rescue purposes. The construction should be such that the individual can be conveniently moved from the body of water onto the deck of the watercraft with the minimum amount of disturbance to his body to avoid aggravating injuries.

It is, therefore, a principal object to this invention to provide an improved rescue type of boat having a deck which is substantially flush with the water level for facilitating transportation of an injured person from the water onto the deck.

It is further object to this invention to provide an improved deck arrangement for such a watercraft that will accommodate transfer of injured persons to the deck and which will also permit the injured person to recline on the deck and receive emergency treatment there, if desirable.

In some regards it also is desirable to provide a way in which the injured person may be easily transferred onto the deck and it is a further object to this invention to provide an improved arrangement for permitting an injured person to be drawn onto the deck from the body of water in which the person is floating.

In connection with this type of watercraft, it is very desirable if the deck can be positioned at the rear of the watercraft so that the injured person may be easily transferred to the deck. However, with conventional types of propulsion devices, such a rear deck position is not always possible.

It is, therefore, a still further object to this invention to provide an improved rescue boat propelled by jet propulsion units so as to facilitate a low rear deck onto which injured persons may be readily transferred from the body of water in which the watercraft is operating.

In the aforenoted copending application, there is disclosed a patrol boat that meets these requirements. However, in conjunction with such patrol boats, it is also desirable to have a system or litter than can be employed for the purpose of not only keeping the injured person afloat while he is in the body of water, but also for assisting in his transfer into the patrol boat.

As described in the aforenoted copending application, the patrol boat is provided with a rear deck portion that opens generally at the water level and into which the injured person can be easily transported. It is also disclosed in that application how warm water discharged from the powering engine's cooling system can be discharged into this deck area to keep the temperature of the injured person elevated. There is obviously an advantage if the litter employed to transport the injured person to the deck area can also be used to suspend the person's body when in the deck area and also to permit the heated water to circulate across his body.

It is, therefore, a principal object of this invention to provide an improved litter that can be utilized for rescuing injured persons at sea.

It is a further object of this invention to provide an improved litter for rescuing injured persons and which permits the flotation of the injured person in the body of water and also transportation into the deck area of the associated patrol boat.

It is a further object of this invention to provide a combined patrol boat litter arrangement wherein the transfer of injured persons is facilitated and the treatment of the injured person is also facilitated.

SUMMARY OF THE INVENTION

A first feature of this invention is adapted to be embodied in a rescue boat that is comprised of a hull having a centrally positioned rider's area for accommodating at least one operator, a control for the rescue boat in the rider's area and a transom with a deck opening through the transom at the rear of the rider's area. The deck has at least a rear portion disposed substantially at the water level during normal positions of the hull when floating for facilitating the entry of an injured person onto the deck and a side deck positioned above said deck at at least one side thereof for accommodating a person to assist the injured person.

Another feature of this invention is adapted to be embodied in a litter for sea rescue that is comprised of a pair of side poles, an open netting affixed at opposite sides to a respective one of the side poles and which is adapted to receive the body of a victim. Buoyancy devices are associated with each of the side poles for flotation of the litter in a body of water with the victim thereon.

Still another feature of this invention is adapted to be utilized with a rescue boat that is comprised of a hull having a transom with a deck opening through the transom and having a rear portion disposed substantially at the water level for facilitating the entry of an injured person onto the deck. A litter as described in the preceding paragraph is adapted to be brought into the deck opening and the sides of the deck are provided with attachment means for holding the poles of the litter to retain the victim in the deck area.

DETAILED DESCRIPTION OF THE PREFERRED EMBODIMENTS OF THE INVENTION

Figure 5:
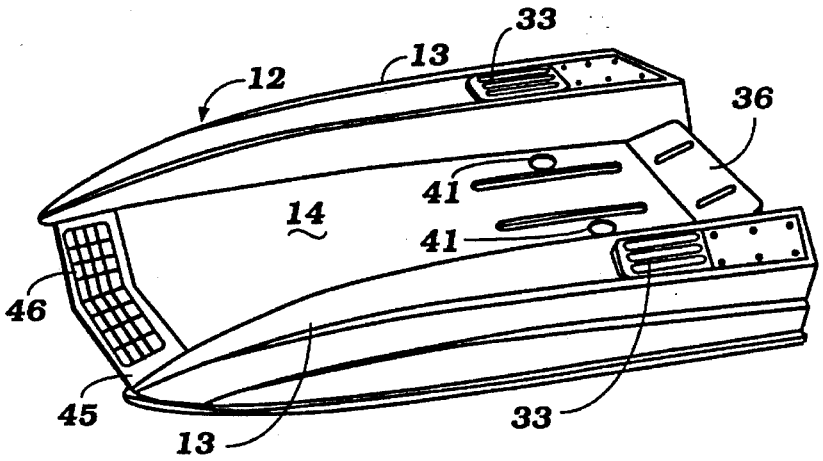
FIG. 5 is a perspective front side view of the underside of the hull showing the rear deck portion lowered.
Figure 6:
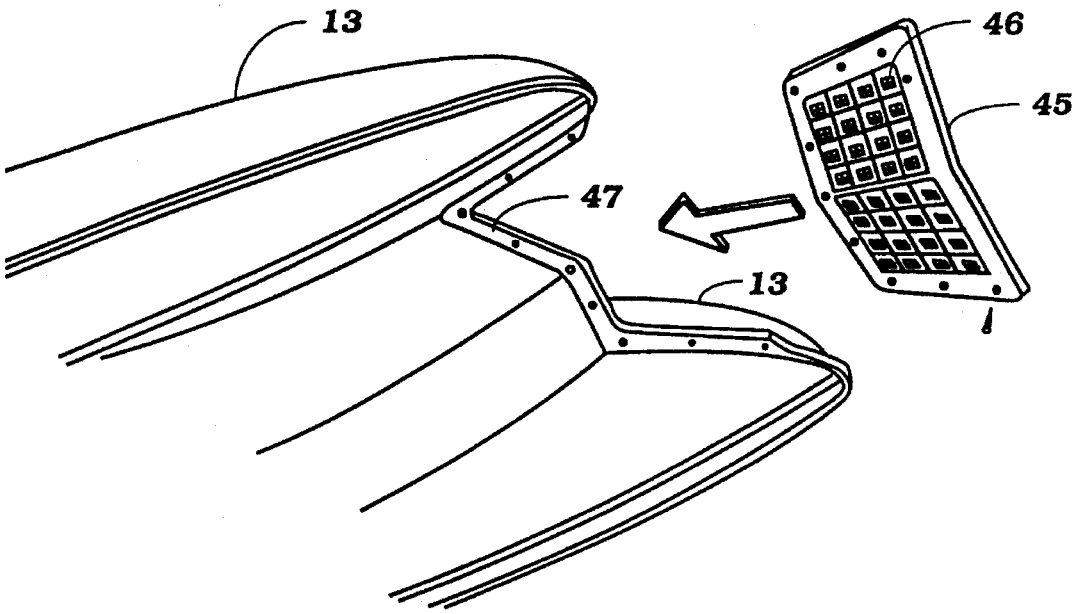
FIG. 6 is a partially exploded view showing the removable front deck portion.

In the drawings, a patrol or rescue watercraft constructed in accordance with an embodiment of the invention is identified generally by the reference numeral 11. The watercraft 11 is comprised of a hull having a lower portion, indicated generally by the reference numeral 12, which is configured as a catamaran, as may be clearly seen in FIGS. 5 and 6, wherein there are provided a pair of spaced apart hull portions 13 separated by a recessed lower hull area 14. A deck, indicated generally by the reference numeral 15, is connected to the lower hull portion 12 in a suitable manner. The deck 15 and lower hull portion 12 are formed from suitable materials, such as molded fiberglass reinforced resin or the like.

A rider's cockpit 16 is formed by the deck 15 and is located generally centrally in the longitudinal fore and aft direction of the watercraft 11. The rider's area 16 includes a pair of seats 17 with a watercraft control area 18 being positioned at the front of one of the seats 17. The rider's area 16 is designed so as to accommodate, in addition to two seated passengers, individuals standing.

An enlarged storage area 19 is formed in the deck 15 forwardly of the rider's area 16 and is accessible through a pivotally supported hatch cover 21. The hatch cover 21 has a pivotal support to the deck 15 at its forward end for pivotal movement about a generally transversely extending axis so as to access the storage compartment 19. A stay 22 may be provided so as to permit retention of the hatch cover 15 in its open position.

Forwardly of the storage compartment 19, there is provided a further area 23 in which a fuel tank 24 is provided for containing fuel for the engines of the watercraft 11, as will be described. The fuel tank 24 may be accessible for filing through the hatch cover 21 when it is pivoted in an open position. Alternatively, an external fuel filler may be provided for the fuel tank 24. The areas under the seats 17 may accommodate a pair of batteries 25 for supply of electrical power for the watercraft 11.

It should be noted that the catamaran hull portions 13 extend generally forwardly beyond the forward periphery of the fuel tank 24 and thus provide an open area, for a purpose which will be described. In addition, the hull portions 13 are filled with a buoyant flotation media 26, such as a foamed plastic or the like, and this buoyant material extends back to opposite sides of the rider's compartment 16.

At the rear portions of each of the catamaran hulls 13 there is provided an engine compartment 27 which is disposed rearwardly of the rider's compartment 16 and in which internal combustion engines 28 of any known type are accommodated. The engines 28 are water cooled, as is typical with the marine practice. The cooling water for the engines 28 is drawn from the body of water in which the watercraft is operated in any known manner, and is circulated through the cooling jackets and, if desired, exhaust manifolds of the engines 28. This water is then discharged either directly back into the body of water in which the watercraft is operating, or into a deck area, to be described and for a purpose to be described.

Rearwardly of the engine compartments 27 and separated therefrom by bulkheads 29 are tunnel areas 31 in which jet propulsion units 32 are supported. The jet propulsion units 32 are driven by the engines 28 respectively, and have downwardly facing water inlet openings 33 (FIG. 5) through which water is drawn. Impeller portions are formed behind the water inlet portions 33 and contain impellers driven by the engines 28. The water pumped by the impellers is then discharged through respective steering nozzles 34 that are supported for pivotal movement about vertically extending steering axes, as is well known in this art, and which are operated by the control 18 in a well known manner.

Figure 7:
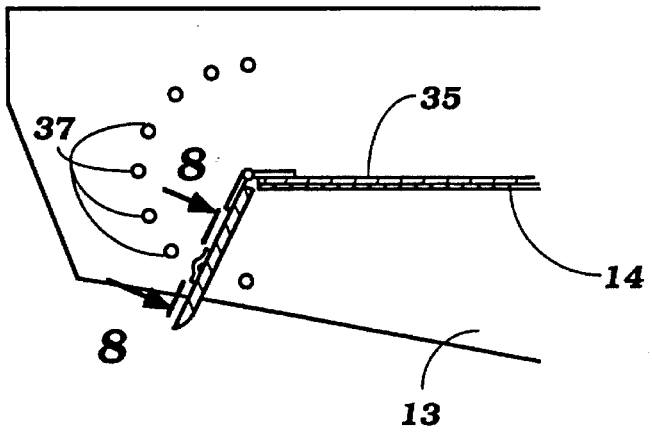
FIG. 7 is a cross-sectional view showing how the angle of the rear portion of the rear deck can be adjusted.
Figure 8:
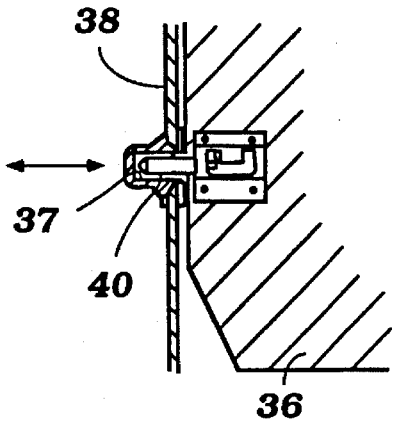
FIG. 8 is a cross-sectional view taken along the line 8—8 of FIG. 7 and shows how the latching mechanism for the rear deck portion operates.

The area to the rear of the passenger's compartment 16 and between the engine compartments 27 and tunnels 31 provides a deck area 35 which is opened to the rear of the watercraft 11 and specifically through the transom so that injured persons may be drawn onto the deck area 35 in a manner which will be described. The rear portion of the deck area 35 is provided with a pivotally supported panel 36 which may be adjusted to any of a variety of angular positions as set by a plurality of ampetures 37 (FIGS. 7 and 8) formed in the side walls 38 of the hull surrounding the deck area 35. The panel 36 may be adjusted to any desired angular position as shown in FIG. 7 so as to facilitate the moving of an injured person onto the deck area 35.

Figure 16:
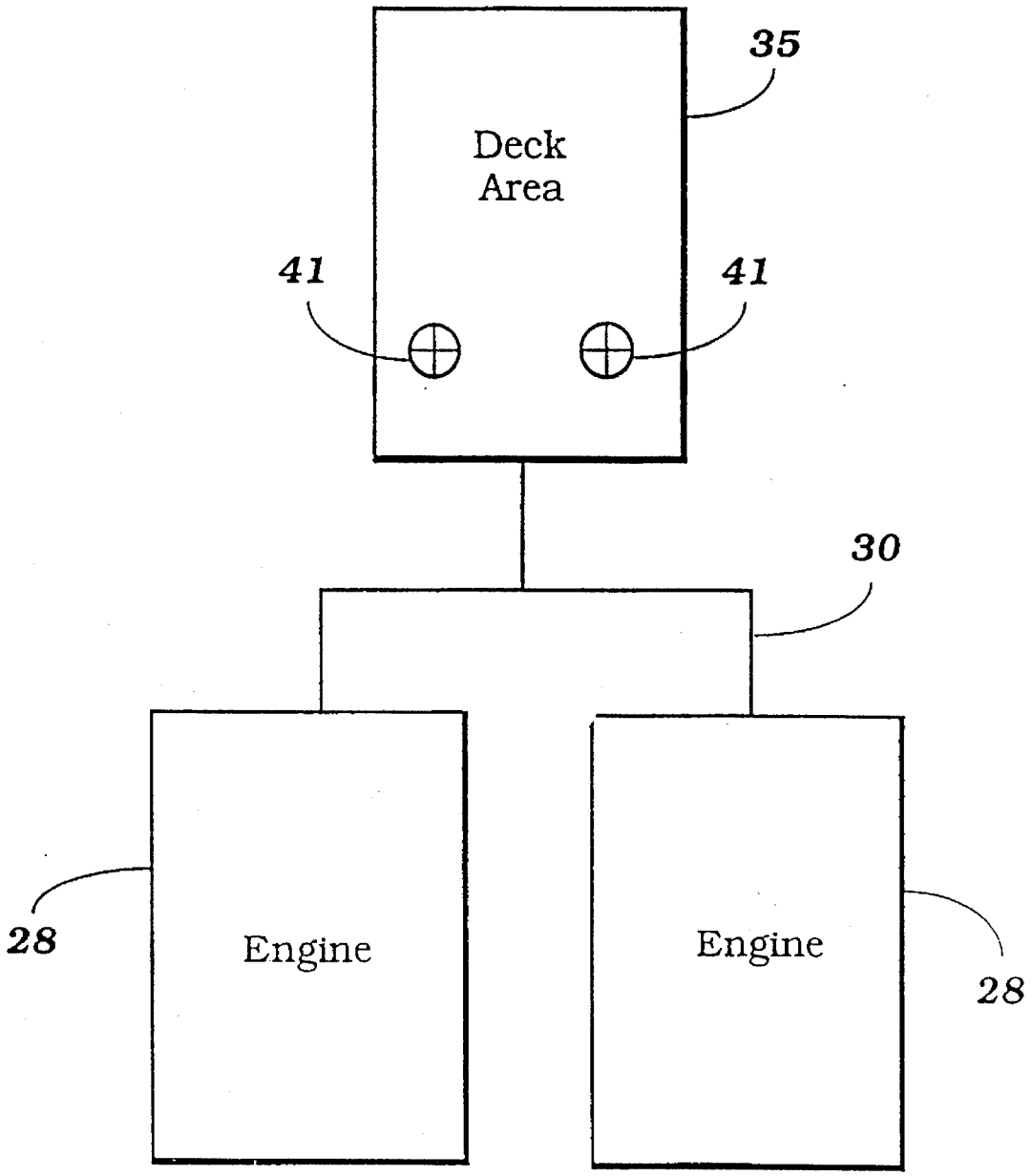
FIG. 16 is a schematic view showing how the engine coolant may be delivered to the deck area for heating the body of an injured person.

The panel 36 may then be pivoted upwardly so as to prevent the injured person from falling off of the deck area 35 and also so as to form a dam that can be filled with heated water from the cooling jackets of the engines 28 for heat treatment of an injured individual. As has been previously noted, the engines 28 are cooled by water that is drawn from the body of water in which the watercraft 11 is operated. This water may be discharged rearwardly into the deck area 35 through a suitable conduit 30, as shown schematically in FIG. 16 so as to flood the deck area 35 and provide heat for the victim, which has been drawn into this deck area. If desired, the engine coolant can be continuously discharged into the deck area 35, even when a victim is not in this area. A sliding pin type latch 40 is provided at each side of the panel 36 to lock it in the respective position. A pair of drain openings 41 are provided in the deck area 35 and may be opened and closed so as to permit the heated water from the engines 28 to be retained in this area or drained from it.

Figure 1:
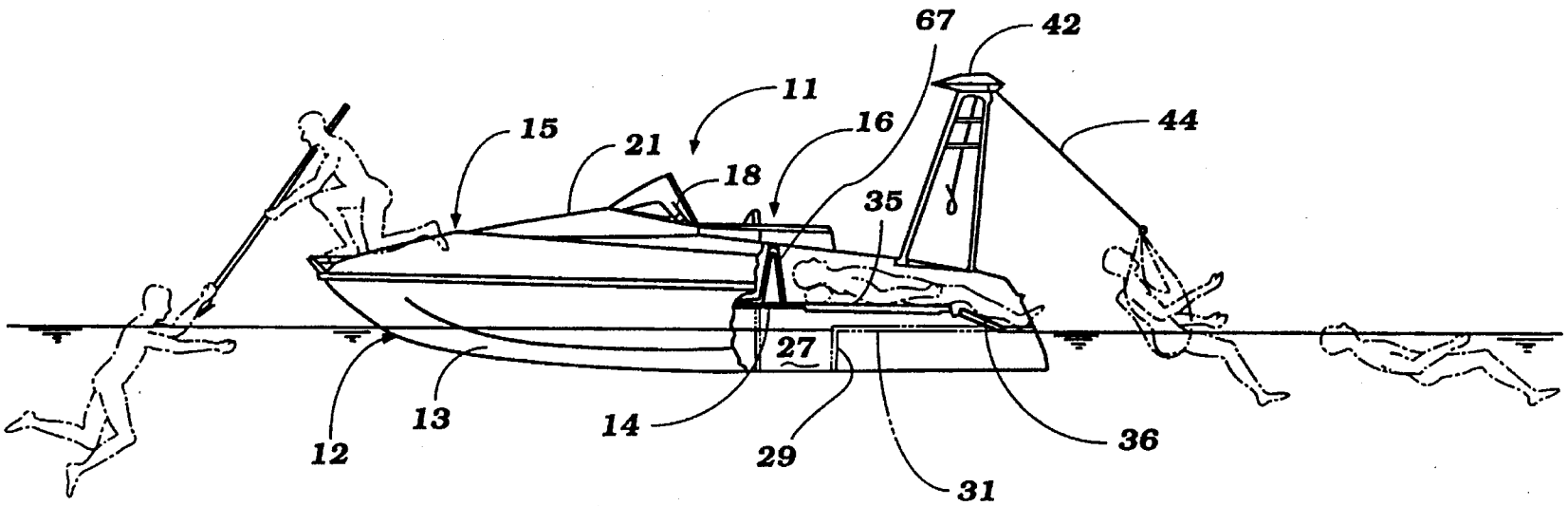
FIG. 1 is a side elevational view of a watercraft constructed in accordance with an embodiment of the invention and shows various ways in which the watercraft can be utilized to rescue persons from the body of water.
Figure 2:
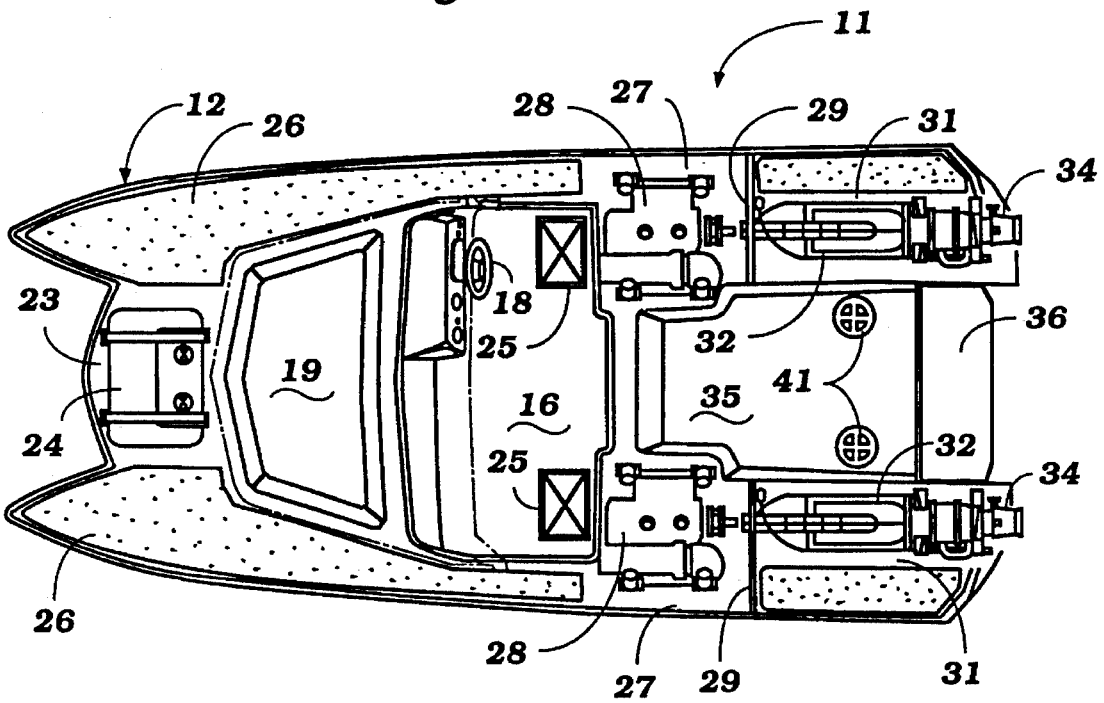
FIG. 2 is a top plan view of the watercraft, with portions broken away, so as to more clearly show the construction.
Figure 3:
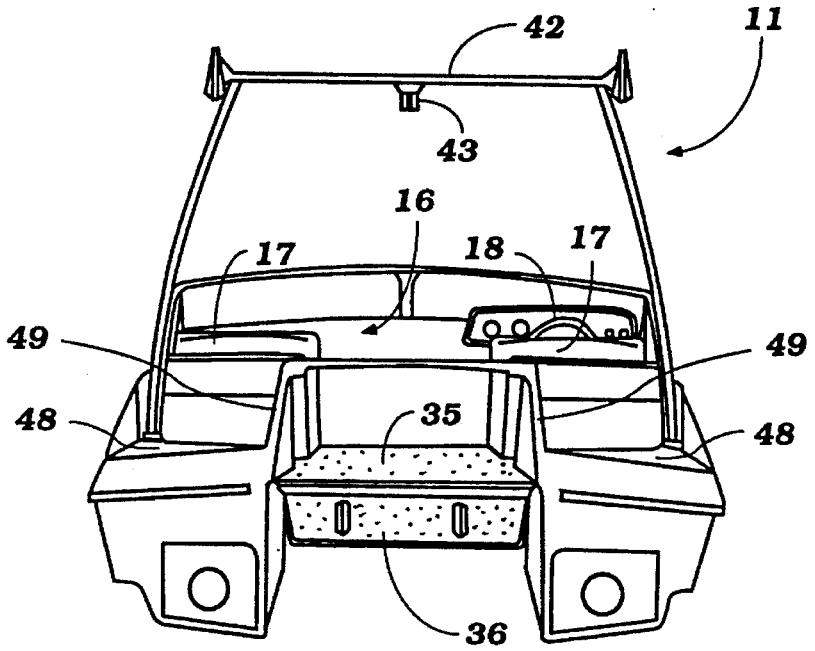
FIG. 3 is a rear elevational view thereof and shows the rear portion of the deck in its lowered position.
Figure 4:
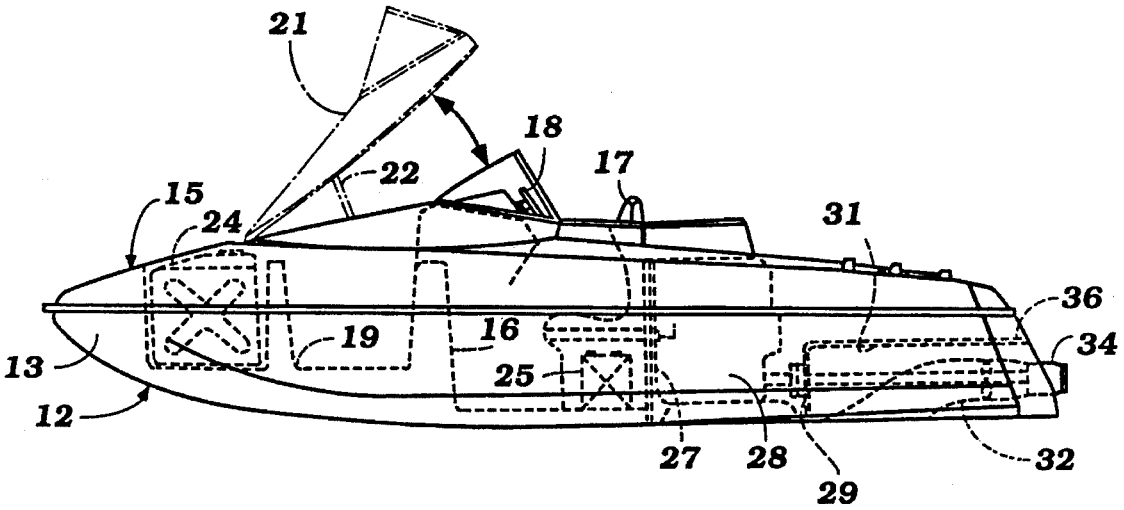
FIG. 4 is a side elevational view of the watercraft and shows in phantom how the hatch cover may be opened.
Figure 9:
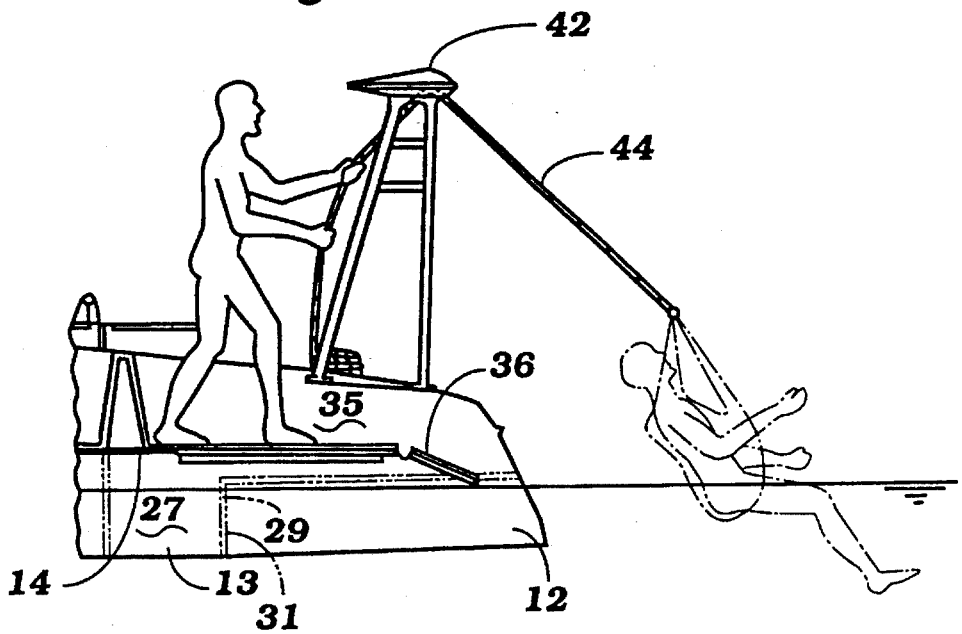
FIG. 9 is an enlarged side elevational view showing the transfer of an injured person onto the deck.

In order to assist in transporting injured persons onto the deck area 35, there is provided a bridge 42 which spans the deck area 35 and which has a pulley 43 formed therein to accommodate a rope 44 so as to assist in the movement of an injured person into the deck area 35, as clearly shown in FIGS. 1 and 9.

As has been previously noted, there is a gap between the forward portions of the catamaran hulls 13 and a deck piece 45 having perforated openings 46 is adapted to be detachably affixed to a flange 47 (FIGS. 5 and 6) formed on the peripheral edge of the hull portion 12 so as to accommodate a person standing at the front of the deck, as shown in FIG. 1, for further rescue operations. The deck piece 45 may be easily removed so as to offer greater access, and the perforated openings 46 offer a better foot grip by giving a textured configuration and permit drainage.

In order to facilitate treatment of a person contained within the deck area 35, the areas outwardly of the deck area 35 are provided with relatively flat floor areas 48 that can be entered from the passenger's compartment 16 by the riders of the watercraft 11. These floor areas 48 are separated from the deck area 35 by raised walls 49 so as to provide side-to-side containment for the victim. It should be noted that the floor areas 48 are spaced slightly vertically above the deck area 35 so as to make treatment more convenient and still maintain separation.

It should be readily apparent from the foregoing description that the described watercraft is particularly useful in providing a rescue or patrol boat and because of the use of the catamaran type hulls and side-by-side jet propulsion units, a large deck area is provided at the rear that will easily accommodate the transfer of injured persons onto the deck area and the treatment of these injured persons there.

In accordance with an important feature of the invention, there is provided an improved type of litter which can be employed in conjunction with the rope 44 and bridge 42 for assisting in the transfer of injured persons into the deck area 35. In addition, this litter is designed so as to keep the victim afloat before the transfer has been completed, and also so as to permit the heated water, which may be flooded into the deck area 35, to contact the injured person while still on the litter.

This litter is shown in detail in FIGS. 10–15 and is identified generally by the reference numeral 51. The litter 51 is comprised of a pair of side poles 52 which may be formed from any lightweight material, such as tubular aluminum or the like. The ends of the side poles 52 are provided with handles 53 which may be formed from a rubber-like material so as to facilitate their being gripped and to avoid slippage of the gripper's hands.

A central net 54 of an open mesh and formed from a suitable material, such as nylon or the like, is provided with a plurality of loops 55 (FIG. 15) through which the poles 52 may be slid. The loops 55 are spaced apart sufficiently so as to accommodate flotation buoys 56 which are disposed slidably on the poles 52 and held longitudinally in place by the loops 55. These floats or buoys 56 may be formed from a suitable material, such as a foamed plastic, such as styrofoam or the like.

Figure 11:
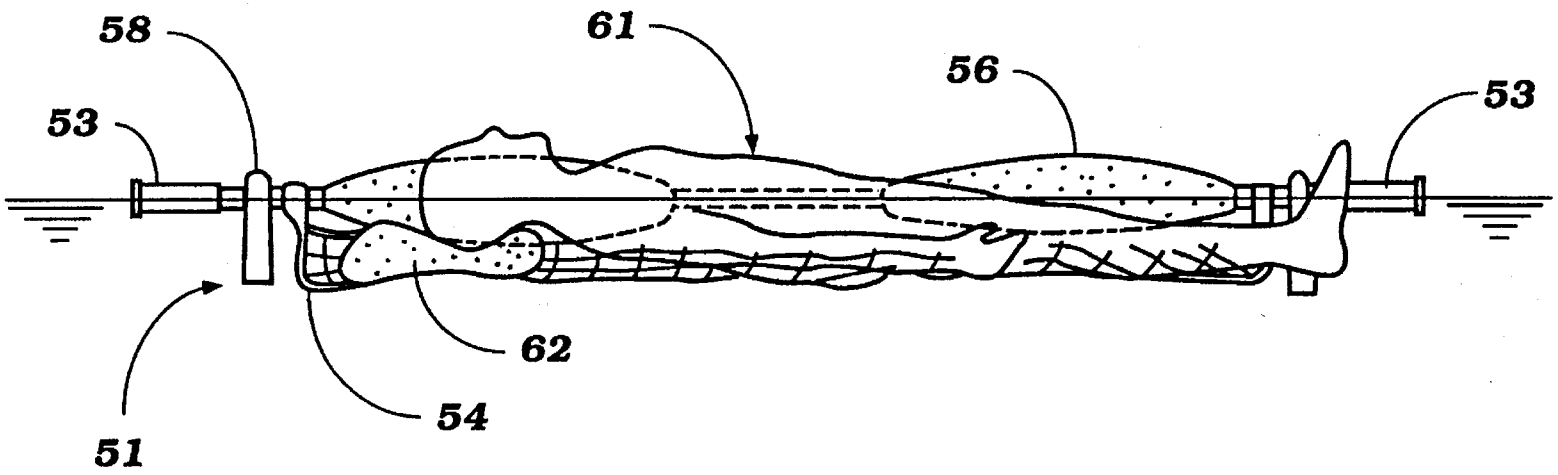
FIG. 11 is a side elevational view showing how a victim can float on the litter in the body of water.

In order to provide some rigidity for the netting 54, there are provided at the ends a pair of detachable cross-rods 57 that can be detachably connected to brackets 58 formed at the ends of the side poles 52 and affixed thereto in any suitable manner. The attachment of the cross-rods 57 may be by threaded fasteners 59. By using the cross-rods 57, the structure has rigidity so as to comfortably support a victim, as shown in FIG. 11, and the buoyancy of the floats 56 is sufficient so that when the victim, as shown at 61 in FIG. 11, is on the litter 51, he will be floating with his head above the water, but still partially submerged therein.

If desired, a detachable pillow 62 can be affixed to the netting 54 by a hook and loop type fastener 63 so as to offer further comfort for the injured person, either within the body of water or when transferred into the deck area 35.

When not in use, the rods 57 can be removed and then the litter 51 can be conveniently rolled into a compact configuration for storage.

Figure 10:
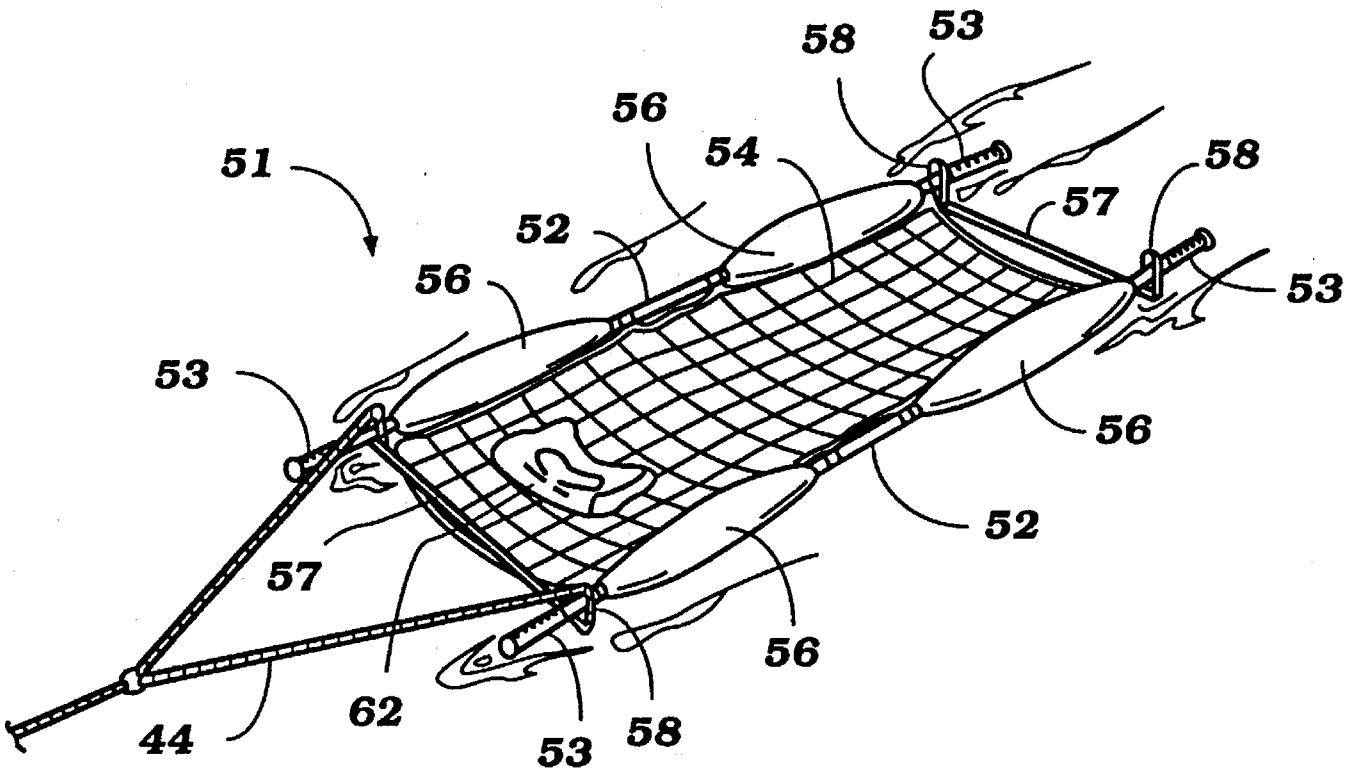
FIG. 10 is a perspective top view showing a litter that can be utilized with the patrol boat and which is constructed in accordance with an embodiment of the invention. The litter is shown floating on the body of water and without the victim in position.
Figure 12:
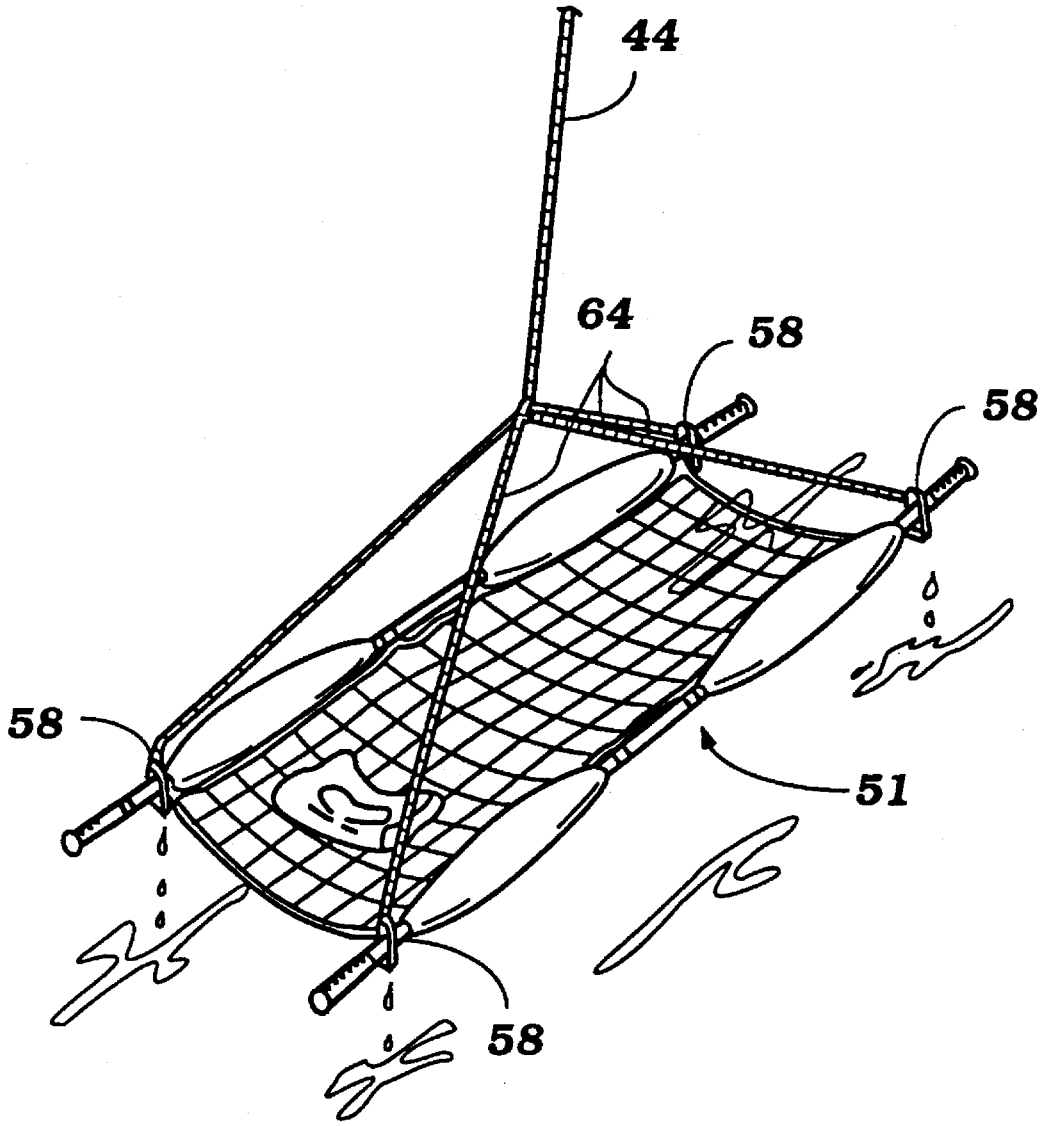
FIG. 12 is a perspective view showing one way in which the litter may be raised for transferring the victim to the deck area of the patrol boat.
Figure 13:
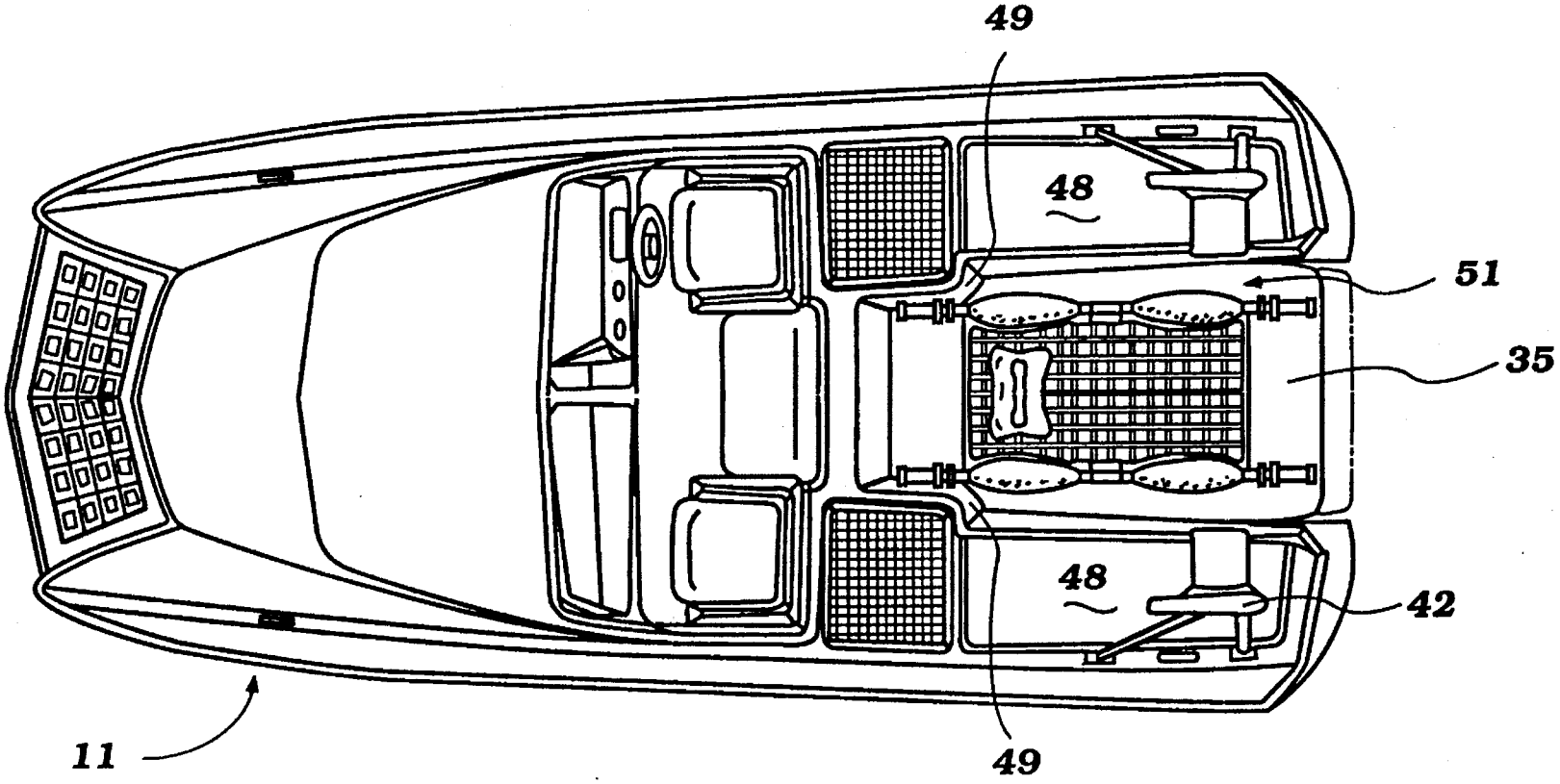
FIG. 13 is a top plan view showing the litter in place in the deck of the patrol boat.
Figure 14:
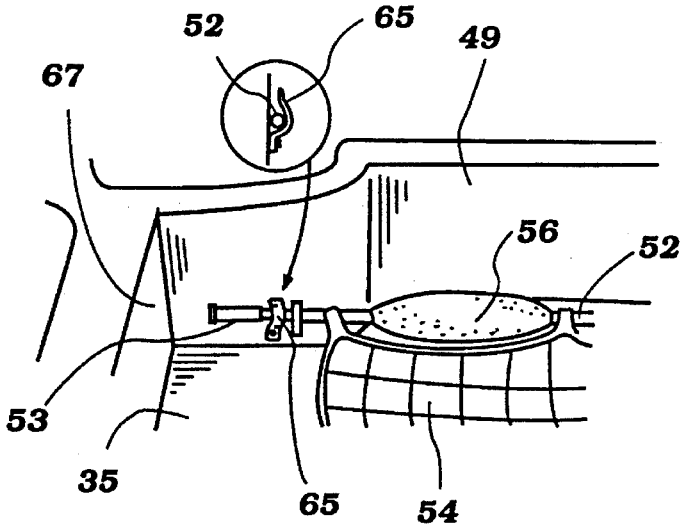
FIG. 14 is a perspective view showing how the litter is held in the deck area.
Figure 15:
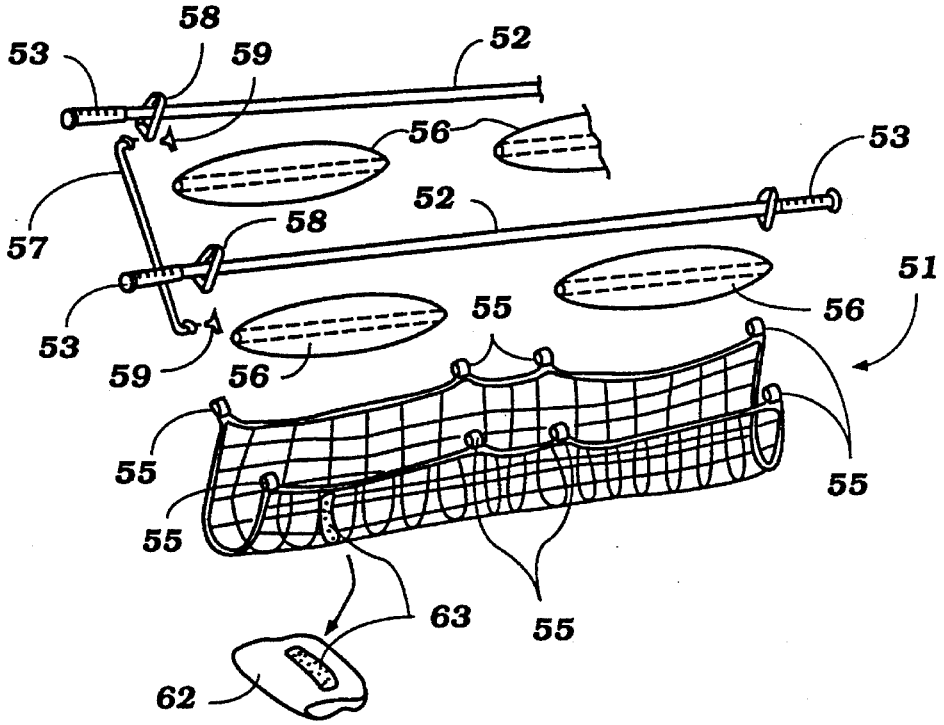
FIG. 15 is an exploded perspective view of the litter.

As may be seen in FIG. 12 the brackets 58 form a convenient way in which a roping 64 may be connected so as to permit lifting of the entire litter 51 with the victim in place out of the body of water by the rope 44 and bridge 42. Alternatively, only the front brackets 58 may be connected to the rope 44, as shown in FIG. 10, so as to pull the litter 51 and injured person into the deck area 35.

In order to further restrain the litter 51 and injured person within the deck area 35, there are provided pairs of support brackets 65 on the opposing side walls 49 of the deck area onto which the side poles 52 may be slipped. The brackets 65 may be positioned at such a height so as to hold the body of the victim above the lower wall of the deck area 35 so as to further improve water circulation around him. The side walls 49 terminate at a front wall 67 which forms the forward end of the deck area 35.

Thus, it is believed readily apparent that the described litter has a great utility for use in water rescue, and also has particular utility in conjunction with the type of patrol boat 11 previously described. Of course, the foregoing description is that of preferred embodiments of the invention, and various changes and modifications may be made without department form the spirit and scope of the invention, as defined by the appended claims.

I claim:

1. A rescue boat comprising a hull having a centrally positioned rider's area for accommodating at least one rider and containing a control for said rescue boat, a transom, a deck opening through said transom at the rear of said rider's area and having a rear portion disposed substantially at the water level when the hull is normally floating in the water for facilitating the entry of injured persons onto said deck, the length of said deck being sufficient to accommodate substantially only a person lying in a prone condition, and a propulsion device for said hull on at least one side of the deck.

2. A rescue boat as set forth in claim 1 wherein there is a pair of propulsion devices, each provided on a respective side of the deck.

3. A rescue boat as set forth in claim 2 wherein the propulsion devices comprise jet propulsion units.

4. A rescue boat as set forth in claim 3 wherein there are provided a pair of floor areas on opposite sides of the deck and above the propulsion devices and jet propulsion units adapted to a accommodate standing riders for assisting an injured person in the deck.

5. A rescue boat as set froth in claim 1 wherein the rear portion of the deck is pivotal for adjusting its position relative to the water.

6. A rescue boat as set froth in claim 1 further including hoist means over the deck opening for assisting in drawing injured persons onto the deck.

7. A rescue boat as set forth in claim 1 wherein the hull has a catamaran type configuration comprised of a pair of catamaran hulls disposed on opposite sides of the deck opening.

8. A rescue boat as set forth in claim 7 wherein the forward portion of the catamaran hulls defines a recessed area.

9. A rescue boat as set froth in claim 8 further including a removable rigid deck panel adapted to be affixed across the recessed opening.

10. A rescue boat as set forth in claim 9 wherein the rigid deck panel is perforated.

11. A rescue boat and litter for sea rescue, said litter comprising a pair of side poles, an open netting affixed at each side to a respective one of said side poles and adapted to receive the body of a victim and buoyant devices associated with each of said side poles for flotation of said litter in a body of water with a victim there, said rescue boat comprising a hull having a transom, a deck opening through said transom and having a rear portion disposed substantially at the water level for facilitating the entry of injured persons onto said deck, and said deck having sufficient length to accommodate said litter and being provided with facing sidewalls, each carrying interlocking devices adapted to be engaged by said side poles for retaining said litter within said deck.

12. The litter of claim 11, further including detachable cross-rods extending between opposite ends of the side poles for maintaining the netting in an extended condition.

13. The litter of claim 11, further including hook and loop fasteners on the open netting and on an associated pillow for affixing the pillow to the netting for the victim's head.

14. The litter of claim 11, further including a pair of handle grips at opposite ends of each of the side poles for carrying of the litter.

15. The litter of claim 14, further including detachable cross-rods extending between opposite ends of the side poles for maintaining the netting in an extended condition.

16. The litter of claim 14, further including hook and loop fasteners on the open netting and on an associated pillow for affixing a pillow to the netting for the victim's head.

17. The litter of claim 16, further including detachable cross-rods extending between opposite ends of the side poles for maintaining the netting in an extended condition.

18. A rescue boat and litter as set forth in claim 11, wherein the rescue boat is provided with a propulsion device on at least one side of the deck opening.

19. A rescue boat and litter as set forth in claim 18, wherein there is a pair of propulsion devices, each provided on a respective side of the deck opening.

20. A rescue boat and litter as set forth in claim 18, wherein the propulsion devices comprise jet propulsion units.

21. A rescue boat and litter as set forth in claim 20, further including selectively operable drain means for draining water from the deck area and means for delivering coolant from an engine to the deck area for heating an injured person's body.

22. A rescue boat and litter as set forth in claim 21, wherein the rear portion of the deck is pivotal for adjusting its position relative to the water.

23. A rescue boat and litter as set forth in claim 22, wherein the pivotal deck portion is moveable between lowered into-the-water position and raised position for forming a dam to retain water in the deck area.

24. A rescue boat and litter as set forth in claim 22, further including hoist means over the deck opening for attachment to said litter assisting in drawing injured persons and said litter onto the deck.

25. A rescue boat and litter as set forth in claim 11, further including selectively operable drain means for draining water from the deck area and means for delivering coolant from an engine to the deck area for heating an injured person's body.

26. A rescue boat and litter as set forth in claim 25, wherein the rear portion of the deck is pivotal for adjusting its position relative to the water.

27. A rescue boat and litter as set forth in claim 26, wherein the pivotal deck portion is moveable between lowered into-the-water position and raised position for forming a dam to retain water in the deck area.

28. A rescue boat and litter as set forth in claim 11, wherein the hull has a catamaran the configuration comprised of a pair of catamaran hulls disposed on opposite sides of the deck opening.

29. A rescue boat comprising a hull having a lower portion submerged in a body of water and an upper portion defining a forward deck area, an uncovered centrally positioned operators area with controls for operating the boat to the rear of said forward deck, and a rear deck spanning the area to the rear of said operators area, and a transom, said rear deck opening through said transom and having a rear portion disposed substantially at the water level under normal conditions of said hull in the body of water for facilitating the entry of injured persons onto said deck and a pair of propulsion devices, each provided on a respective side of the rear deck and spaced outwardly therefrom.

30. A rescue boat as set forth in claim 29 wherein the length of the rear deck is sufficient to accommodate a person lying in a prone condition.

31. A rescue boat as set forth in claim 29, wherein the propulsion devices comprise jet propulsion units.

32. A rescue boat as set forth in claim 31, wherein the rear portion of the rear deck is pivotal relative to the remainder of the hull for adjusting its position relative to the water.

33. A rescue boat as set forth in claim 32 wherein the pivotal portion of the rear deck is moveable between lowered into-the-water position and raised position for forming a dam to retain water in the deck area.

34. A rescue boat as set forth in claim 32 further including hoist means over the rear deck for assisting in drawing injured persons onto the rear deck.

35. A rescue boat as set forth in claim 29 wherein the rear portion of the rear deck is pivotal relative to the remainder of the hull for adjusting its position relative to the water.

36. A rescue boat as set forth in claim 35 wherein the pivotal portion of the rear deck is moveable between lowered into-the-water position and raised position for forming a dam to retain water in the deck area.

37. A rescue boat as set forth in claim 29 wherein the hull has a catamaran-type configuration comprised of a pair of spaced apart hulls.

38. A rescue boat as set forth in claim 37 wherein a forward portion of the hulls defines a recessed opening.

39. A rescue boat as set forth in claim 38 further including a removable panel adapted to be affixed across the recessed opening.

40. A rescue boat as set forth in claim 39 wherein the panel is perforated.

* * * * *